US010722019B2

(12) United States Patent
Debaecker et al.

(10) Patent No.: US 10,722,019 B2
(45) Date of Patent: Jul. 28, 2020

(54) HINGED APPLICATOR FOR A COSMETIC PRODUCT AND ASSOCIATED PACKAGING AND APPLICATION ASSEMBLY

(71) Applicant: L'OREAL, Paris (FR)

(72) Inventors: Xavier Debaecker, Asnieres (FR); Sylvain De Raemy, Cormeilles en Parisis (FR); Patrice Barre, Saint Ouen (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/303,302

(22) PCT Filed: May 26, 2017

(86) PCT No.: PCT/EP2017/062802

§ 371 (c)(1),
(2) Date: Nov. 20, 2018

(87) PCT Pub. No.: WO2017/203050

PCT Pub. Date: Nov. 30, 2017

(65) Prior Publication Data

US 2019/0208891 A1 Jul. 11, 2019

(30) Foreign Application Priority Data

May 27, 2016 (FR) ..... 16 54806

(51) Int. Cl.
*A45D 34/04* (2006.01)
*A45D 40/26* (2006.01)

(52) U.S. Cl.
CPC ..... *A45D 34/045* (2013.01); *A45D 40/265* (2013.01)

(58) Field of Classification Search
CPC .. A45D 34/045; A45D 40/265; A46B 5/0041; A46B 5/0075; A46B 5/0083; A46B 5/0058
See application file for complete search history.

(56) References Cited

U.S. PATENT DOCUMENTS 1,369,664 A * 2/1921 Izawa ..... A46B 5/0075 15/167.1
4,370,989 A * 2/1983 Taylor ..... A45D 34/042 132/317
5,572,763 A * 11/1996 Eguchi ..... A46B 5/0075 15/144.1

(Continued)

FOREIGN PATENT DOCUMENTS

BE 461-488 A 12/1945
EP 0-791-307 A1 8/1997

*Primary Examiner* — David P Angwin
*Assistant Examiner* — Bradley S Oliver
(74) *Attorney, Agent, or Firm* — Polsinelli PC

(57) ABSTRACT

The present invention relates to a cosmetic product applicator (14), of (lie type comprising: an application member (30) extending along a first longitudinal axis (34), a first end of said application member comprising an application element (42); and a gripping member (32) extending along a second longitudinal axis (36) and connected by a hinge (60, 76) to a second end (46) of the application member. The applicator timber comprises a removable locking element (33) forming a first stop between the gripping member and the application member, so as to lock the hinge and keep the first and second longitudinal axes substantially parallel.

20 Claims, 3 Drawing Sheets

(56) References Cited

U.S. PATENT DOCUMENTS

| | | | | |
|---|---|---|---|---|
| 5,735,298 | A * | 4/1998 | Mayne | A46B 5/005 132/309 |
| 5,906,214 | A * | 5/1999 | Gueret | A45D 34/045 132/314 |
| 6,026,823 | A * | 2/2000 | Gueret | A45D 34/046 132/218 |
| 8,020,243 | B2 * | 9/2011 | Hupence | A46B 5/0075 15/144.1 |
| 2007/0079844 | A1 * | 4/2007 | Dieudonat | A45D 40/265 132/218 |
| 2015/0164210 | A1 * | 6/2015 | Lou | A46B 9/021 401/129 |

* cited by examiner

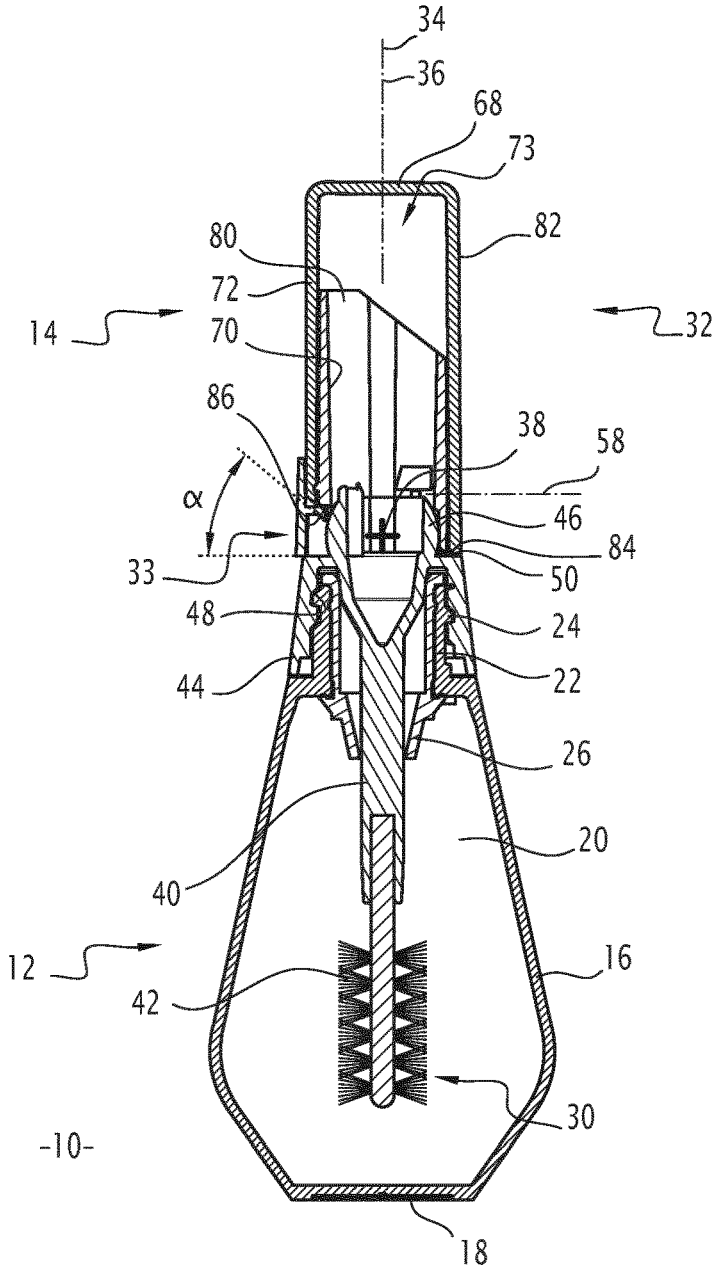
FIG.1
FIG.2
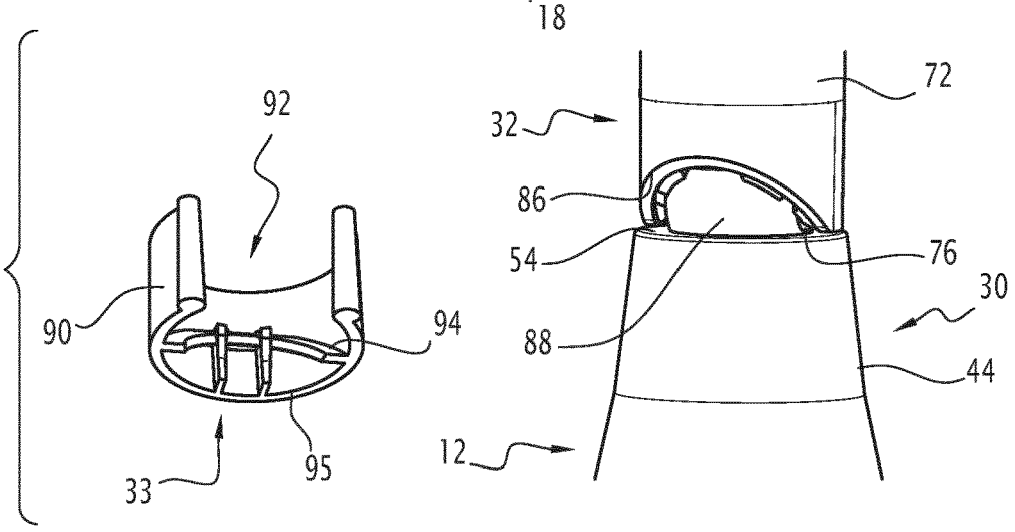

-210-

HINGED APPLICATOR FOR A COSMETIC PRODUCT AND ASSOCIATED PACKAGING AND APPLICATION ASSEMBLY

CROSS REFERENCE TO RELATED APPLICATIONS

This application is the National Phase of Application No. PCT/EP2017/062802 filed May 26, 2017, which claims priority to Application No, 16544806 filed in France on May 27, 2016 under 35 U.S.C. § 119. The entire contents of each application are hereby incorporated by reference.

The present invention relates to a cosmetic product applicator, of the type comprising: an application member extending along a first longitudinal axis, a first end of said application member comprising an application element; and a gripping member extending along a second longitudinal axis and connected by a hinge to a second end of the application member.

The term "cosmetic product", refers, according to this invention, to a product as defined in Regulation (EC) N° 1223/2009 of the European Parliament and of the Council of Nov. 30, 2009, on cosmetic products.

The cosmetic product for which the applicator according to the invention is intended is in particular in the form of a powder, a compacted solid, or a fluid such as a liquid. The product is advantageously a product intended to be placed on the keratin fibers of a user, such as the eyelashes or the eyebrows. The product is for example a makeup product such as a mascara.

In order to benefit from improved ergonomics for applying makeup, it is known to provide applicators of the type cited above, wherein the application element can be oriented in a variable manner with respect to the gripping member. Such a hinged applicator is particularly described in the document EP1369056, held by the Applicant. The industrial manufacture of such hinged applicators typically comprises one or a plurality of assembly and/or conveying steps, during which the gripping member can be inclined with respect to the application element. Applicators of different inclinations can as such be found mixed together on a conveying line before screwing onto an associated container. The position of the applicators on the conveyor is thus uncertain, which complicates the gripping thereof by an automaton or an operator with a view to screwing, as well as any packaging thereof after screwing. Furthermore, applicators in the inclined position take up more space on the conveyor than "straight" applicators wherein the application member is substantially aligned with the gripping member.

In order to solve this problem, it is known to use conveying platforms comprising housings which hold the applicators in the "straight" position until screwing or packaging.

The aim of the present invention is that of facilitating the industrial manufacture of such hinged applicators, particularly by doing away with the use of such conveying platforms.

For this purpose, the invention relates to an applicator of the type cited above, further comprising a removable locking element. Advantageously, said removable locking element forms a first stop between the gripping member and the application member, so as to lock the hinge and keep the first and second longitudinal axes substantially aligned.

The locking element thereby makes it possible to keep the application member and the gripping member aligned, during the manufacture of the applicator and the assembly thereof with a container.

According to further advantageous aspects of the invention, the applicator comprises one or several of the following features taken in isolation or in any technically possible combination:

- the removable locking element is suitable for snap-fastening, or in other words snap-locking, in a reversible manner about an external lateral surface of the gripping member or of the application member; and said removable locking element comprises a first and a second opposite stop surfaces, each of the first and second stop surfaces being respectively suitable for coming into contact with the gripping member and the application member, so as to form the first stop;
- each of the application and gripping members comprises an orifice, the removable locking element being suitable for being inserted into both orifices at the same time so as to lock the hinge and keep the first and second longitudinal axes substantially parallel;
- the removable locking element comprises a frangible portion formed on the application member or on the gripping member, said frangible portion being suitable for breaking or bending under the action of a rotation of the gripping member with respect to the application member by means of the hinge;
- the hinge between the gripping member and the application member is a pivot connection along a third axis of rotation substantially perpendicular to the first and second longitudinal axes, the gripping member and the application member being configured such that the gripping member is movable with respect to the application member about said third axis of rotation, between a first and a second positions of the second longitudinal axis with respect to the first longitudinal axis, said first and second positions being determined respectively by a second and by a third stops formed by the gripping member against the application member;
- an angular clearance of the gripping member with respect to the application member, between the first and second positions, is between 30° and 60°;
- the first position of the second longitudinal axis with respect to the first longitudinal axis corresponds to the substantially parallel first and second longitudinal axes; such a configuration makes it possible to keep the applicators "straight" during storage or conveying;
- an axial end of the gripping member, close to the hinge, is formed by a first and by a second adjacent edges, the first edge being substantially perpendicular to the second longitudinal axis, the second edge being inclined with respect to said first edge, each of said first and second edges being respectively suitable for forming the second and third stops, respectively with a first and a second surface of the application member;
- each of the second edge of the gripping member and of the second surface of the application member is respectively suitable for coming into contact with the first and the second stop surfaces of the removable locking member, so as to form the first stop;
- the frangible portion extends into an internal space of the gripping member; it is as such invisible from outside the applicator;
- the frangible portion is rigidly connected to one of the application or gripping members and forms the first stop in contact with an internal wall of the other of the application or gripping members;
- the frangible portion extends axially from the second edge of the gripping member or from the second surface of the application member, said frangible portion abutting respectively against the second surface of the application member or against the second edge of the application member.

The invention further relates to an assembly for packaging and applying a cosmetic product comprising: a cosmetic product applicator as described above, and a container intended to contain said cosmetic product, the applicator and the container comprising a reversible assembly device in a storage configuration, wherein the application element of the applicator is received in an internal volume of the container.

The invention will be easier to understand in view of the following description, provided solely as a non-restrictive example and with reference to the drawings, wherein:

FIG. 1 is a longitudinal cross-section view of a packaging and application assembly according to a first embodiment of the invention, in a first configuration;

FIG. 2 is a perspective view of the packaging and application assembly in FIG. 1, in a second configuration;

Figure 6:
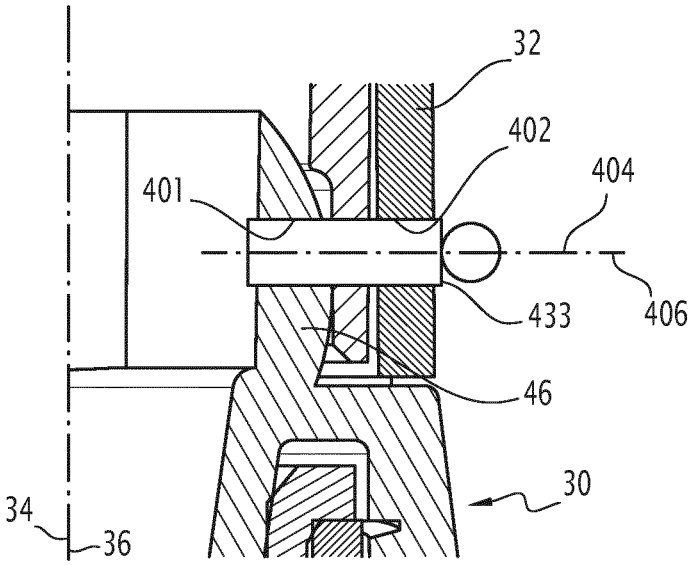
FIG. 6 is a detailed, longitudinal cross-section view of an alternative embodiment of FIG. 1.

FIGS. 1 and 2 show a cosmetic product packaging and application assembly 10 according to a first embodiment of the invention. FIG. 6 shows an alternative embodiment of the assembly 10.

Figure 3:
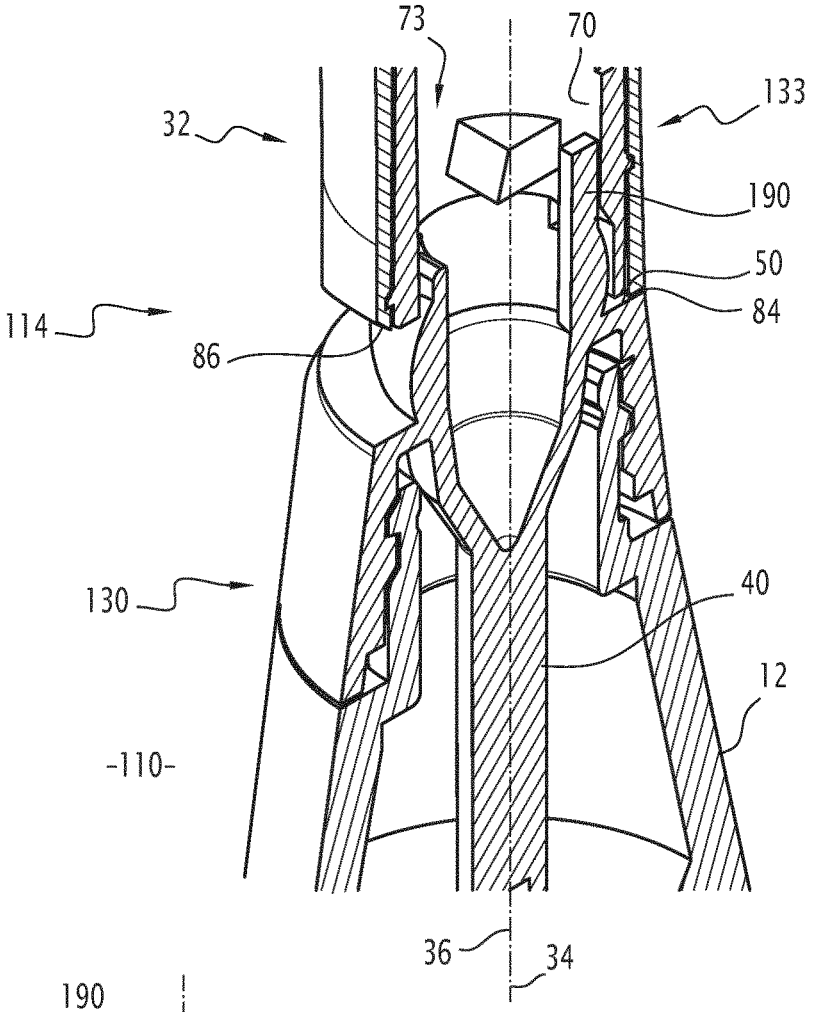
FIG. 3 is a detailed, longitudinal cross-section view of a packaging and application assembly according to a second embodiment of the invention.
Figure 4:
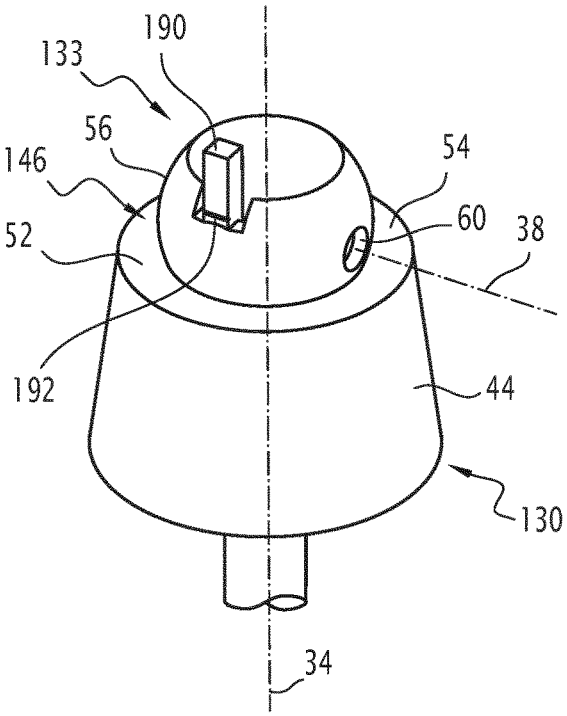
FIG. 4 is a detailed view of an element of the packaging and application assembly in FIG. 3.
Figure 5:
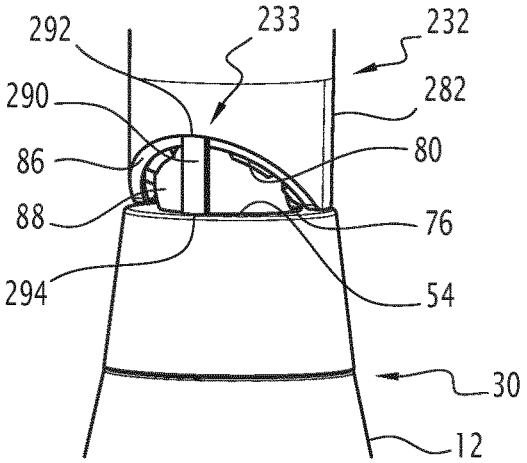
FIG. 5 is a detailed, perspective view of a packaging and application assembly according to a third embodiment of the invention.

FIGS. 3 and 4 show a cosmetic product packaging and application assembly 110 according to a second embodiment of the invention. FIG. 5 shows a cosmetic product packaging and application assembly 210 according to a third embodiment of the invention.

Apart from differences detailed hereinafter, the assemblies 10, 110 and 210 are equivalent and will be described simultaneously. The elements common to the assemblies 10, 110 and 210 are designated by the same reference numbers.

The assembly 10, 110, 210 is particularly intended for packaging and applying mascara. The assembly 10, 110, 210 particularly comprises a container 12 and an applicator 14, 114, 214.

The container 12 particularly comprises a side wall 16 and a bottom 18, which define an internal volume 20 suitable for receiving a cosmetic product, in particular a liquid mascara type composition.

The container 12 further comprises a neck 22, of tubular shape, wherein an external wall comprises a thread 24.

The container 12 also comprises a squeezing member 26, also of tubular shape, inserted into the neck 22 and extending into the internal volume 20.

The applicator 14, 114, 214 comprises an application member 30, 130 and a gripping member 32, 232, hinged with respect to one another. The applicator 14, 114, 214 further comprises a removable locking element 33, 133, 233, suitable for keeping the application 30, 130 and gripping 32, 232 members stationary with respect to one another.

A detailed view of the application member 130 and of the removable locking element 133 of the assembly 110 is shown in FIG. 4.

In the embodiments in FIGS. 1 to 5, the application 30, 130 and gripping 32, 232 members extend respectively along a first longitudinal axis 34 and along a second longitudinal axis 36; and said application 30, 130 and gripping 32, 232 members are connected by a pivot connection along a third axis of rotation 38, perpendicular to the first 34 and second 36 longitudinal axes.

According to an alternative embodiment not shown, the application and gripping members are connected by another type of hinge, for example a swivel connection.

FIGS. 1, 2, 3 and 5 show the applicator 14, 114, 214 in a first angular configuration, wherein the first 34 and second 36 longitudinal axes are merged.

The application member 30, 130 comprises: a rod 40 extending along the first longitudinal axis 34; an application head 42, arranged at a first end of the rod; a cap 44 for closing the container 12; and a hinge element 46, 146 with the gripping member 32, 232. The closing cap 44 and the hinge element 46, 146 are arranged at a second end of the rod 40.

The application head 42 is typically a mascara brush or comb. More particularly, the application head 42 comprises an elongated core, as well as a plurality of reliefs such as bristles or pins, projecting laterally from said core.

The closing cap 44 is preferably formed from one piece, or in other words integral, with the second end of the rod 40. Said closing cap has substantially the shape of a ring arranged along the first longitudinal axis 34. An internal surface of said ring comprises an internal thread 48. Said internal thread is suitable for engaging with the thread 24 of the neck 22 to assemble the container 12 and the applicator 14, 114, 214 in a storage configuration, represented in FIGS. 1, 2, 3 and 5. In said storage configuration, the applicator 14, 114, 214 closes the container 12 and the application head 42 is received in the internal volume 20.

According to alternative embodiments not shown, further known devices for assembling the closing cap 44 and the neck 22 are used, such as a snap-locking or other assembly device.

An axial end of the closing cap 44, opposite the application head 42, consists of a ring-shaped surface 50. In the embodiment illustrated, said surface 50 is planar, perpendicular to the first longitudinal axis 34 and oriented in the opposite direction to the application head 42. Alternatively, this surface can be non-planar and/or non-perpendicular to the first axis.

It is considered that the surface 50 is formed from a first 52 and a second 54 half-rings, situated on either side of a plane comprising the first longitudinal axis 34 and the third axis of rotation 38.

The hinge element 46, 146 extends the closing cap 44 axially from the surface 50, said hinge element 46, 146 and closing cap 44 being formed preferably from one piece, or in other words integral.

In the embodiment illustrated, the hinge element 46, 146 comprises a rounded body 56, having substantially the shape of a sphere portion comprised between two perpendicular planes to the first longitudinal axis 34. Said two planes are respectively referred to as the proximal plane and distal plane 58 of the hinge element 46, 146. The proximal plane, closest to the application element 42, corresponds to the plane of the surface 50 in the shape of a ring.

The hinge element 46, 146 further includes two circular cavities 60, formed on either side of the rounded body 56. The two circular cavities 60 are suitable for forming a hinge with the gripping member 32, 232 to represent the third axis of rotation 38, as described hereinafter.

The gripping member 32, 232 has a substantially tubular shape extending along the second longitudinal axis 36. A distal end 68 of the gripping member 32, 232, furthest from the third axis of rotation 38, is preferably closed. The other end, referred to as proximal, is open.

The gripping member 32, 232 comprises an internal wall 70 and an external wall 72, arranged about the second longitudinal axis 36. The internal wall 70 defines a chamber 73 inside the gripping member.

The internal wall 70 comprises two lugs 76 situated facing one another, in radial projection. The lugs 76 are inserted into the circular cavities 60 of the hinge element 46, 146. The lugs 76 and the circular cavities 60 thereby form a hinge, representing the third axis of rotation 38 of the gripping member 32, 232 with respect to the application member 30, 130.

In the embodiments in FIGS. 1, 2, 3 and 5, the gripping member 32, 232 is formed from an internal sleeve 80 and an external cover 82, 282 inserted and fastened into one another. At the proximal end of the gripping member 32, 232, the internal 70 and external 72 walls are respectively formed by the sleeve 80 and by the cover 82, 282.

The proximal end of the gripping member 32, 232 is represented by a first 84 and a second 86 edge of the external cover 82, 282. Said first 84 and second 86 edges are adjacent and substantially arranged on either side of a plane containing the second longitudinal axis 36 and the third axis of rotation 38. Each of the first 84 and second 86 edges forms a substantially planar surface. The first edge 84 is substantially perpendicular to the second longitudinal axis 36.

The second edge 86 is formed by a beveled cut in the cover 82, 282. More specifically, the second edge 86 is substantially parallel to the third axis of rotation 38 and inclined by an angle $\alpha$ with respect to the first edge 84. The angle $\alpha$ is between 5° and 90°, preferentially between 30° and 60°, and more preferentially equal to approximately 45°

In the first angular configuration of the applicator 14, 114, 214, as shown in FIGS. 1, 2, 3 and 5, the first 34 and second 36 longitudinal axes are substantially merged and the first edge 84 of the gripping member 32, 232 is in contact with the first half-ring 52 of the application member 30, 130. A rounded surface 88 of the rounded body 56 is visible between said second edge 86 and said second half-ring 54.

In a second angular configuration, not shown, the first 34 and second 36 longitudinal axes are inclined by an angle $\alpha$ and the second edge 86 of the gripping member 32, 232 is in contact with the second half-ring 54 of the application member 30, 130.

The first and second angular configurations described above therefore define the set of possible angular configurations of the gripping member 32, 232 with respect to the application member 30, 130.

The removable locking element 33, 133, 233 is suitable for forming a stop between the application member 30, 130 and the gripping member 32, 232, so as to lock the hinge 60, 76 and hold the applicator 14, 114, 214 in the first angular configuration.

In the embodiment in FIGS. 1 and 2, the removable locking element 33 of the applicator 14 is suitable for being assembled with external surfaces of the application member 30 and/or of the gripping member 32. In particular, the removable locking element 33 comprises an open ring 90, or clip, of substantially cylindrical shape with the exception of a side opening 92. The removable element 33 further comprises a lip 94 forming an internal projection with respect to the clip 90, facing the side opening 92.

In connection with the removable element 33, the applicator 14 can adopt an assembled configuration, shown in FIG. 1, and a separated configuration, shown in FIG. 2.

In the assembled configuration, the clip 90 is fitted elastically around the external wall 72, at the proximal end of the gripping member 32, and around the rounded surface 88 of the application member 30. The cylindrical shape of the clip 90 is then arranged along the second longitudinal axis 36, merged with the first longitudinal axis 34. A proximal end of the clip 90 is formed by a circular edge 95, which comes into contact with the second half-ring 54 of the application member 30.

Moreover, in the assembled configuration, the lip 94 comes into contact with the second edge 86 of the gripping member 32. As such, the circular edge 95 and the lip 94 form a stop preventing said second half-ring 54 and said second edge 86 from being moved closer together. The gripping member 32 is therefore locked in rotation with respect to the application member 30.

According to one alternative embodiment of the applicator 14, the removable locking element is suitable for being assembled with internal surfaces of the application member and/or of the gripping member. In particular, according to one alternative embodiment shown in a detailed view in FIG. 6, each of the hinge element 46 of the application member and of the gripping member 32 comprises a through orifice, respectively 401 and 402. Said orifices 401 and 402 have a similar shape, for example circular of the same diameter. Said orifices 401 and 402 are respectively arranged along a fourth axis 404, substantially perpendicular to the first longitudinal axis 34, and along a fifth axis 406, substantially perpendicular to the second longitudinal axis 36. In the first angular configuration, corresponding to the merged first 34 and second 36 longitudinal axes, the fourth 404 and fifth 406 axes are also merged. The orifices 401 and 402 are then aligned. According to said alternative embodiment, the removable locking element comprises a pin 433 of substantially cylindrical shape, substantially equal in diameter to the diameter of the orifices 401 and 402. The pin 433 is suitable for being inserted into said aligned orifices, by translation along the fourth 404 or fifth 406 axis, to lock the application and gripping members in the first configuration. The pin 433 can also be removed from the orifices 401 and 402 by a reverse movement, so as to unlock said application and gripping members.

In the embodiments in FIGS. 3 and 4 and in FIG. 5, the removable locking element 133, 233 of the applicator 114, 214 comprises a frangible portion 190, 290, suitable for breaking or bending under the action of a rotation of the gripping member 32, 232 with respect to the application member 30, 130.

In the embodiment in FIGS. 3 and 4, the frangible portion 190 is formed from one piece, or in other words integral, with the application member 130. In particular, the frangible portion 190 has the shape of a stick substantially parallel with the first longitudinal axis 34 and forming a distal projection with respect to the rounded body 56 of the hinge element 146. A junction 192 between the stick 190 and the rounded body 56 preferably comprises a line of weakness such as a slit.

The stick 190 is arranged in the chamber 73. In particular, in an initial configuration of the applicator 114, as shown in FIG. 3, the stick 190 is in contact with the internal wall 70 of the gripping member 32. The stick 190 is therefore not visible from the applicator 114.

On the other hand, in the embodiment in FIG. 5, the frangible portion 290 is arranged outside the chamber 73. Furthermore, in the initial configuration shown in FIG. 5, the frangible portion 290 is formed from one piece, or in other words integral, with the gripping member 232 and is in contact with the application member 30 of the applicator 214.

In particular, the frangible portion 290 has the shape of a tongue substantially parallel with the first longitudinal axis 34 and forming a proximal projection with respect to the second edge 86 of the gripping member 232. A junction 292 connects a distal end of the tongue 290 and said second edge 86. Said junction 292 preferably comprises a line of weakness such as a slit.

A proximal end 294 of the tongue 290 abuts against the second half-ring 54 of the application member 30 of the applicator 214.

The tongue 290 masks at least partially the rounded surface 88 of the rounded body 56 of the application member 30.

A method for manufacturing the assemblies 10, 110 and 210 will now be described. Firstly, the container 12, the application member 30, 130 and the gripping member 32, 232 are manufactured independently from one another. In particular, the rod 40, the closing cap 44 and the hinge element 46, 146 are preferably formed from one piece, or in other words integral, by molding a plastic material. In the case of the assembly 110, the locking element 133, particularly the frangible portion 190, is further formed from one piece, or in other words integral, with the hinge element 146.

The application head 42 is then assembled with the rod 40 to form the application member 30, 130.

The sleeve 80 and the cap 82, 282 are manufactured independently from one another, preferably by molding plastic materials. In the case of the assembly 210, the locking element 233, particularly the frangible portion 290, is particularly formed from one piece, or in other words integral, with the cover 282 or molded onto said cover. The sleeve 80 is then snap-fastened, or in other words snap-locked, inside the cover 82, 282 to form the gripping member 32, 232.

The gripping member 32, 232 is then assembled with the application member 30, 130, by snap-fastening, in other words by snap-locking, the lugs 76 in the circular cavities 60, to form the hinge representing the third axis of rotation 38.

In the embodiment in FIGS. 3 and 4, during said assembly step, the stick 190 of the application member 130 is inserted into the chamber 73 of the gripping member 32 and comes into contact with the internal wall 70. The applicator 114, in the initial configuration, is thus formed.

In the embodiment in FIG. 5, during said assembly step, the tongue 290 of the gripping member 232 abuts against the second half-ring 54 of the application member 30. The applicator 214, in the initial configuration, is thus formed.

In the embodiment in FIGS. 1 and 2, the locking element 33 is manufactured independently from the other elements, particularly by molding a plastic material. The step for assembling the application 30 and gripping 32 members is followed by elastic fitting of the clip 90 around the external surface 72, the lip 94 coming into contact with the second edge 86 of said gripping member 32. The applicator 14, in the assembled configuration in FIG. 1, is thus formed.

According to the alternative embodiment shown in FIG. 6, the elastic fitting of the clip 90 is replaced by inserting the pin 433 in the aligned orifices 401 and 402.

At this stage, the first longitudinal axis 34 of the application member 30, 130 and the second longitudinal axis 36 of the gripping member 32, 232 are merged. Furthermore, the locking element 33, 133, 233 forms a stop preventing the rotation of the gripping member 32, 232 with respect to the application member 30, 130 about the third axis of rotation 38 in both directions of rotation, as described above.

During the conveying or handling of the applicator 14, 114, 214 by automatons, on an assembly line, it is advantageous for the first 34 and second 36 longitudinal axes to be kept merged. The applicator 14, 114, 214 is thereby less bulky and is easier for the automaton to pick up and handle.

The closing cap 44 of the applicator 14, 114, 214 is then screwed onto the neck 22 of a container 12 filled with cosmetic product. The assembly 10, 110, 210 formed thereby is optionally packaged, and marketed.

During the first use of the assembly 10 in FIGS. 1 and 2, the user removes the locking element 33 by elastically deforming the clip 90, before or after unscrewing the closing cap 44. The user can then incline the gripping member 32 with respect to the application member 30, by an angle between 0° and a. After use and reassembly of the closing cap 44 with the container 12, it is possible to put the locking element 33 back in position for the storage of the assembly 10.

During the first use of the assembly 110 in FIGS. 3 and 4, the user applies a force on the gripping member 32, so as to pivot same with respect to the application member 30 to the second angular configuration. The internal wall 70 thereby applies a force on the stick 190, so as to break or deform the junction 192 with the hinge element 146. The user can then freely incline the gripping member 32 with respect to the application member 130, by an angle between 0° and a.

During the first use of the assembly 210 in FIG. 5, the user applies on the gripping member 232 a similar force to the preceding case, so as to deform the tongue 292. Alternatively, the user bends or tears the tongue 290 at the junction 292 before moving said gripping member 232. The user can then freely incline the gripping member 232 with respect to the application member 30, by an angle between 0° and a.

The user selects and modifies the inclination of the first 34 and second 36 longitudinal axes according to the makeup operations performed using the assembly 10, 110, 210.

The invention claimed is:

1. A cosmetic product applicator, comprising: an application member extending along a first longitudinal axis, a first end of said application member comprising an application element; and a gripping member extending along a second longitudinal axis and connected by a hinge to a second end of the application member, wherein the cosmetic product applicator further comprises a removable locking element forming a first stop between the gripping member and the application member, so as to lock the hinge and keep the first and second longitudinal axes parallel, and wherein each of the application and gripping (32) members comprises an orifice, the removable locking element being suitable for being inserted into both orifices at the same time, so as to lock the hinge and keep the first and second (36) longitudinal axes substantially parallel.

2. The cosmetic product applicator according to claim 1, wherein the hinge between the gripping member and the application member is a pivot connection along a third axis of rotation substantially perpendicular to the first and second longitudinal axes, the gripping member and the application member being configured such that the gripping member is movable with respect to the application member about said third axis of rotation, between a first and a second positions of the second longitudinal axis with respect to the first longitudinal axis, said first and second positions being determined respectively by a second and by a third stops formed by the gripping member against the application member.

3. The cosmetic product applicator according to claim 2, wherein an angular clearance (α) of the gripping member with respect to the application member, between the first and second positions, is between 30° and 60°.

4. A cosmetic product applicator, comprising: an application member extending along a first longitudinal axis, a first end of said application member comprising an application element; and a gripping member extending along a second longitudinal axis and connected by a hinge to a second end of the application member, and wherein the cosmetic product applicator further comprises a removable locking element forming a first stop between the gripping member and the application member, so as to lock the hinge and keep the first and second longitudinal axes parallel, wherein the removable locking element comprises a frangible portion formed on the application member or on the gripping member, said frangible portion being suitable for breaking or bending under the action of a rotation of the gripping member with respect to the application member by means of the hinge.

5. The cosmetic product applicator according to claim 4, wherein the hinge between the gripping member and the application member is a pivot connection along a third axis of rotation substantially perpendicular to the first and second longitudinal axes, the gripping member and the application member being configured such that the gripping member is movable with respect to the application member about said third axis of rotation, between a first and a second positions of the second longitudinal axis with respect to the first longitudinal axis, said first and second positions being determined respectively by a second and by a third stops formed by the gripping member against the application member.

6. The cosmetic product applicator according to claim 5, wherein an angular clearance (α) of the gripping member with respect to the application member, between the first and second positions, is between 30° and 60°.

7. A cosmetic product packaging and application assembly, comprising: a container intended to contain the cosmetic product; and a cosmetic product applicator;

the cosmetic product applicator comprising: an application member extending along a first longitudinal axis, a first end of said application member comprising an application element; a gripping member extending along a second longitudinal axis and connected by a hinge to a second end of the application member; and a removable locking element forming a first stop between the gripping member and the application member, so as to lock the hinge and keep the first and second longitudinal axes merged;

wherein the removable locking element is suitable for snap-fastening in a reversible manner about an external lateral surface of the gripping member or of the application member; and said removable locking element comprises a first and a second opposite stop surfaces, so that, in an assembled configuration of the cosmetic product applicator, each of the first and second stop surfaces are in contact with the gripping member and the application member respectively, so as to form the first stop, and wherein the cosmetic product applicator and the container comprise a reversible assembly device able to reversibly assemble the cosmetic product applicator and the container in a storage configuration, such that the application element is received in an internal volume of the container and the cosmetic product applicator is in the assembled configuration.

8. The cosmetic product packaging and application assembly according to claim 7, wherein the hinge between the gripping member and the application member is a pivot connection along a third axis of rotation substantially perpendicular to the first and second longitudinal axes, the gripping member and the application member being configured such that the gripping member is movable with respect to the application member about said third axis of rotation, between a first and a second positions of the second longitudinal axis with respect to the first longitudinal axis, said first and second positions being determined respectively by a second and by a third stops formed by the gripping member against the application member.

9. The cosmetic product packaging and application assembly according to claim 8, wherein an angular clearance (a) of the gripping member with respect to the application member, between the first and second positions, is between 30° and 60°.

10. The cosmetic product packaging and application assembly according to claim 9, wherein the removable locking element comprises: an open ring of substantially cylindrical shape, said open ring comprising a side opening; and a lip forming an internal projection with respect to the open ring, facing the side opening.

11. The cosmetic product packaging and application assembly according to claim 8, wherein the first position of the second longitudinal axis with respect to the first longitudinal axis corresponds to the merged first and second longitudinal axes.

12. The cosmetic product packaging and application assembly according to claim 11, wherein an axial end of the gripping member, close to the hinge, is formed by a first and by a second adjacent edges, the first edge being substantially perpendicular to the second longitudinal axis, the second edge being inclined with respect to said first edge, each of said first and second edges being respectively suitable for forming the second and third stops, respectively with a first and a second surfaces of the application member.

13. The cosmetic product packaging and application assembly according to claim 12, wherein each of the second edge of the gripping member and of the second surface of the application member is respectively suitable for coming into contact with the first and the second stop surfaces of the removable locking member, so as to form the first stop.

14. The cosmetic product packaging and application assembly according to claim 12, wherein the removable locking element comprises: an open ring of substantially cylindrical shape, said open ring comprising a side opening; and a lip forming an internal projection with respect to the open ring, facing the side opening.

15. The cosmetic product packaging and application assembly according to claim 11, wherein the removable locking element comprises: an open ring of substantially cylindrical shape, said open ring comprising a side opening; and a lip forming an internal projection with respect to the open ring, facing the side opening.

16. The cosmetic product packaging and application assembly according to claim 9, wherein the first position of the second longitudinal axis with respect to the first longitudinal axis corresponds to the merged first and second longitudinal axes.

17. The cosmetic product packaging and application assembly according to claim 16, wherein an axial end of the gripping member, close to the hinge, is formed by a first and by a second adjacent edges, the first edge being substantially perpendicular to the second longitudinal axis, the second edge being inclined with respect to said first edge, each of said first and second edges being respectively suitable for forming the second and third stops, respectively with a first and a second surfaces of the application member.

18. The cosmetic product packaging and application assembly according to claim 17, wherein each of the second edge of the gripping member and of the second surface of the application member is respectively suitable for coming into contact with the first and the second stop surfaces of the removable locking member, so as to form the first stop.

19. The cosmetic product packaging and application assembly according to claim 7, wherein the removable locking element comprises: an open ring of substantially cylindrical shape, said open ring comprising a side opening; and a lip forming an internal projection with respect to the open ring, facing the side opening.

20. The cosmetic product packaging and application assembly according to claim 8, wherein the removable locking element comprises: an open ring of substantially cylindrical shape, said open ring comprising a side opening; and a lip forming an internal projection with respect to the open ring, facing the side opening.

* * * * *